US010676911B2

(12) United States Patent
Erlebach

(10) Patent No.: US 10,676,911 B2
(45) Date of Patent: Jun. 9, 2020

(54) RECESSED POINT DRAIN ASSEMBLY

(71) Applicant: QD HOLDINGS I LLC, Cleveland, OH (US)

(72) Inventor: Josef Erlebach, Silverthorne, CO (US)

(73) Assignee: QD Holdings I LLC, Cleveland, OH (US)

( * ) Notice: Subject to any disclaimer, the term of this patent is extended or adjusted under 35 U.S.C. 154(b) by 98 days.

(21) Appl. No.: 15/706,387

(22) Filed: Sep. 15, 2017

(65) Prior Publication Data

US 2018/0171618 A1 Jun. 21, 2018

Related U.S. Application Data

(60) Provisional application No. 62/434,579, filed on Dec. 15, 2016.

(51) Int. Cl.
*E03F 5/04* (2006.01)
*E03C 1/20* (2006.01)

(52) U.S. Cl.
CPC ..... *E03F 5/0407* (2013.01); *E03C 1/20* (2013.01); *E03F 5/0408* (2013.01)

(58) Field of Classification Search
CPC ..... A47K 3/40–405; E03C 1/20; E03F 5/0407–0409
USPC ..... 4/679
See application file for complete search history.

(56) References Cited

U.S. PATENT DOCUMENTS 3,048,911 A 8/1962 Almon
3,420,522 A 1/1969 Elliott
3,547,471 A 12/1970 Dunmire
3,579,670 A 5/1971 Emil
3,700,381 A 10/1972 Deeke
4,052,759 A 10/1977 Hill
4,146,939 A * 4/1979 Izzi ..... E03F 5/0409 4/286
4,306,738 A 12/1981 Lindquist
4,492,391 A 1/1985 Haines
4,502,166 A 3/1985 Brown, Sr.
4,827,539 A 5/1989 Kiziah
4,943,100 A * 7/1990 Emberson ..... E03F 5/0407 210/164
5,190,320 A 3/1993 Hodges
7,213,274 B2 * 5/2007 Cotton ..... E03C 1/22 4/286
7,472,719 B2 * 1/2009 Dallmer ..... E03F 5/0408 137/362
7,997,038 B2 * 8/2011 Warnecke ..... E03F 5/0407 210/164
8,109,539 B2 2/2012 Krohn
8,230,535 B2 * 7/2012 Kik, Sr. ..... A47K 3/40 4/613

(Continued)

*Primary Examiner* — Erin Deery
*Assistant Examiner* — Nicholas A Ros
(74) *Attorney, Agent, or Firm* — BakerHostetler

(57) ABSTRACT

A recessed point drain assembly is described. Embodiments of the recessed point drain assembly can include, but are not limited to, a base plate having a recess, a drain body adapted to be coupled to the base plate by a first plurality of fasteners, and a clamping collar adapted to be coupled to the drain by a second plurality of fasteners. A gasket can be sandwiched between the drain body and the clamping collar. Typically, a top of the recessed point drain assembly can be configured to be substantially flush with a top of a subfloor.

20 Claims, 9 Drawing Sheets

(56) References Cited

U.S. PATENT DOCUMENTS

| | | | | |
|---|---|---|---|---|
| 9,290,925 | B2 | 3/2016 | Majocka | |
| 9,453,331 | B1 * | 9/2016 | Buffington | E03F 5/041 |
| 10,294,652 | B2 | 5/2019 | Erlebach | |
| 2005/0166315 | A1 | 8/2005 | Warnecke et al. | |
| 2010/0133159 | A1 | 6/2010 | Priester | |
| 2012/0036632 | A1 * | 2/2012 | Cook | E03F 5/0408 4/679 |

* cited by examiner

RECESSED POINT DRAIN ASSEMBLY

CROSS-REFERENCE TO RELATED APPLICATION

This application claims the benefit of U.S. Provisional Application No. 62/434,579, filed Dec. 15, 2016.

BACKGROUND

Clamping drain assemblies are well known in the art as being functional and economical. However, a top piece or pieces of the assembly rest on, and extend above, the surface of a subfloor requiring an installer to conform the exterior floor covering (most often tile) around the drain cover. This not only requires additional time and skill when installing a tile floor, but the drain cover breaks up a visual flow of the tile along the floor, which is often not particularly aesthetically pleasing.

DETAILED DESCRIPTION

Figure 1A:
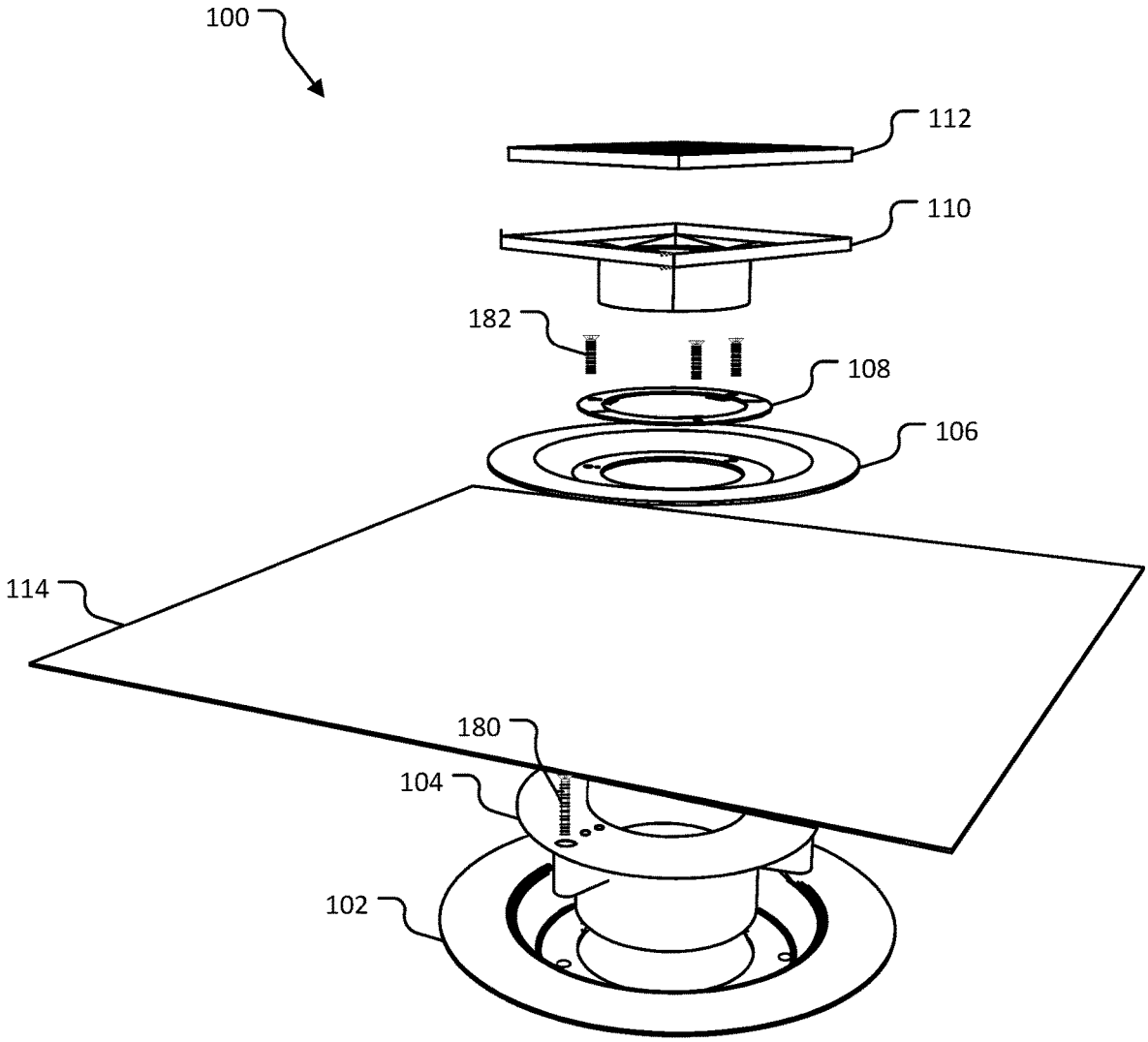
FIG. 1A is an exploded view of a recessed point drain assembly according to one embodiment of the present invention.

Embodiments of the present invention include a recessed point drain assembly configured to sit below or substantially level with a top of a subfloor. The recessed point drain assembly can include, but is not limited to, a base plate, a drain body, and a clamping collar. The drain body can be coupled to the base plate via a first plurality of fasteners. The clamping collar can be configured to couple to the drain body via a second plurality of fasteners. Typically, a gasket can be placed between the clamping collar and the drain body. The drain body can be implemented to couple to a drain pipe and the clamping collar can be implemented to couple the gasket to the recessed drain point assembly.

The base plate can include a flange configured to interface with a top of the subfloor and a recess that extends down below the subfloor. A bottom of the base plate can include a circular hole concentrically located with a center axis of the base plate. The circular hole can be adapted to receive a portion of the drain body. Typically, a top of the drain body can be located below or substantially level with a top of the base plate. For instance, the drain body can sit substantially within the recess of the base plate. For instance, when the drain body is inserted into the recess of the base plate, a top of the drain body can be below or substantially level with a top of the flange of the base plate.

The drain body can include a cylindrical portion and a flange portion. In one embodiment, a plurality of radial legs can be implemented that extend down from the flange portion and radially out from the cylindrical portion. As can be appreciated, the radial legs can be implemented to determine a relative height of the drain body in relation to the base plate. For instance, a bottom of the radial legs can interface with the bottom of the base plate.

In one embodiment, the drain body can include three sets of holes. A first set of holes can include counterbores to flushly receive the first plurality of fasteners. A second set of holes can be implemented to couple to the second plurality of fasteners. For example, the second set of holes can be threaded to threadably couple to a threaded fastener. A third set of holes can be implemented to receive a rod having a distal end configured to pierce the gasket. The third set of holes and accompanying rods can be implemented to align the drain body with the clamping collar.

In one embodiment, the drain body can include a plurality of protrusions that extend out from a top of the drain body in lieu of the third set of holes. The plurality of protrusions can be implemented to mate with a plurality of holes in the clamping collar. When the plurality of protrusions are aligned with the plurality of holes of the clamping collar, the drain body can be aligned with the clamping collar, and the second plurality of fasteners can be passed through the clamping collar and threadably couple to the drain body.

The clamping collar can include two sets of holes. A first set of holes can be implemented to receive the second plurality of fasteners to couple the clamping collar to the drain body. To help align the first set of holes of the clamping collar with the second set of holes of the drain body, the rods (or protrusions) can be implemented to pierce through the gasket and insert into a second set of holes of the clamping collar. When the rods are inserted into the second set of holes of the clamping collar, the first set of holes of the clamping collar can be aligned with the second set of holes of the drain body. As can be appreciated, when the gasket is place over the drain body, an installer would not be able to see where the second of holes of the drain body are located. The rods can be implemented to pierce through the gasket and help the installer line the holes of the drain body and the clamping collar.

In one embodiment, a strainer base can be coupled to the drain body. The strainer base can be configured to receive a strainer and can be configured to direct water towards the recessed point drain assembly. In one example, the strainer can be a floor covering having one or more holes to allow water to drain there through. In another example, the strainer can be a preformed rigid plate having a plurality of holes that can be sized to fit within the strainer base.

In some embodiments, the recessed point drain assembly can include a ring having at least two internal protrusions configured to threadably couple to a pipe having threading on an exterior of the pipe. As can be appreciated, the ring can be implemented to couple to strainer assemblies including at least a pipe having external threads. For instance, a strainer assembly can be threadably coupled to the ring. Typically, the ring can be placed on top of the clamping collar before the second plurality of fasteners are each inserted through the first set of holes of the clamping collar. As can be appreciated, the ring can be coupled to the recessed point drain assembly via the second plurality of fasteners.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Recessed Point Drain Assembly

Figure 1B:
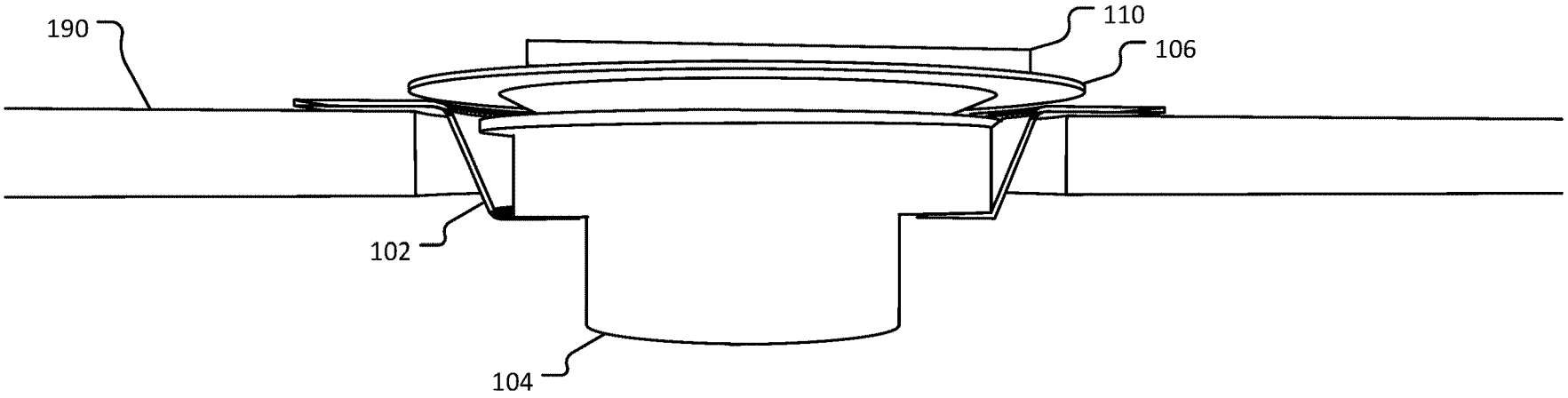
FIG. 1B is a partial cross-sectional view of a recessed point drain assembly according to one embodiment of the present invention.

Referring to FIGS. 1A-1B, detailed diagrams of an embodiment 100 of a recessed point drain assembly is illustrated. FIG. 1A is an exploded view of the recessed point drain assembly 100 and FIG. 1B is a partial cross-sectional view of the recessed point drain assembly 100. The recessed point drain assembly 100 can be implemented to provide an aesthetically pleasing drain that can be located below a floor covering in a shower. Typically, the recessed point drain assembly 100 can be inserted into a hole in a subfloor of the shower stall.

As shown in FIG. 1A, the recessed point drain assembly 100 can include, but is not limited to, a base plate 102, a drain body 104, and a clamping collar 106. In some instances, the drain assembly 100 can further include, but is not limited to, a ring member 108, a strainer base 110, and a strainer 112. For illustrative purposes only, a gasket 114 is shown between the drain body 104 and the clamping collar 106. As can be appreciated, the gasket 114 can be implemented to create a water tight seal between the drain body 104 and the clamping collar 106.

The gasket 114 can typically be made of any suitable material, but can be typically flexible permitting the gasket 114 to generally conform to an underlying floor surface. In at least some variations, the material can be similar to material used in waterproof membranes that are typically bonded over a shower stall subfloor and any sloped insert panels prior to tiling the floor. In some variations, the gasket 114 can be molded to have a recessed portion that can be received into a recess of the base plate 102. In other variations, the gasket 114 can be provided flat but can be made of an elastomeric material that conforms to the recess by stretching. In some embodiments, the gasket 114 can include a center opening that can be sandwiched between flat surfaces of the drain body 104 and the clamping collar 106 forming a water tight seal. In some instances, a center opening can be cut into the gasket 114 after the gasket has been sandwiched between the drain body 104 and the clamping collar 106. The gasket 114 can extend outwardly from the rest of the recessed point drain assembly 100 resting on a surface of a subfloor. During installation, portions of the gasket 114 can be adhesively secured to the subfloor. Additionally, a waterproof membrane used to cover a shower stall subfloor prior to tiling can be overlapped with the gasket 114 and adhesively secured to the gasket 114 to form a watertight seal.

Figure 2A:
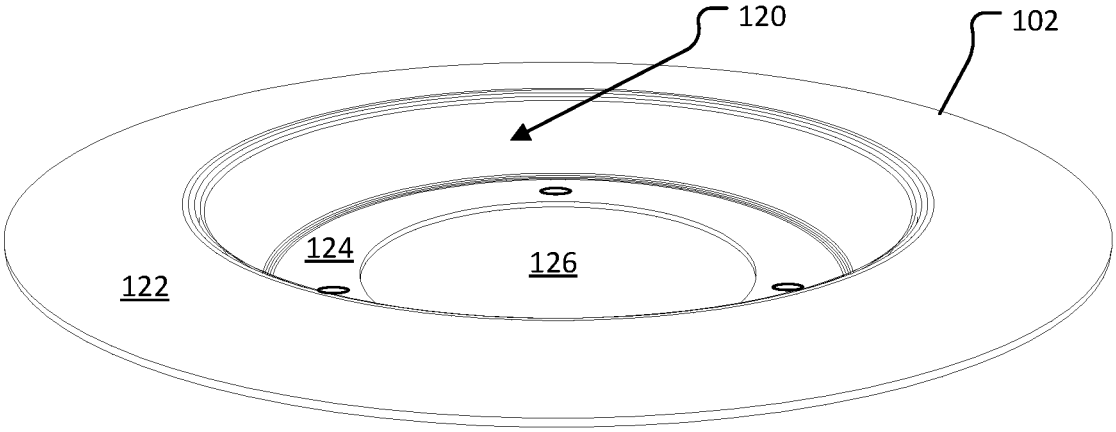
FIG. 2A is an isometric view of a base plate according to one embodiment of the present invention.
Figure 2B:
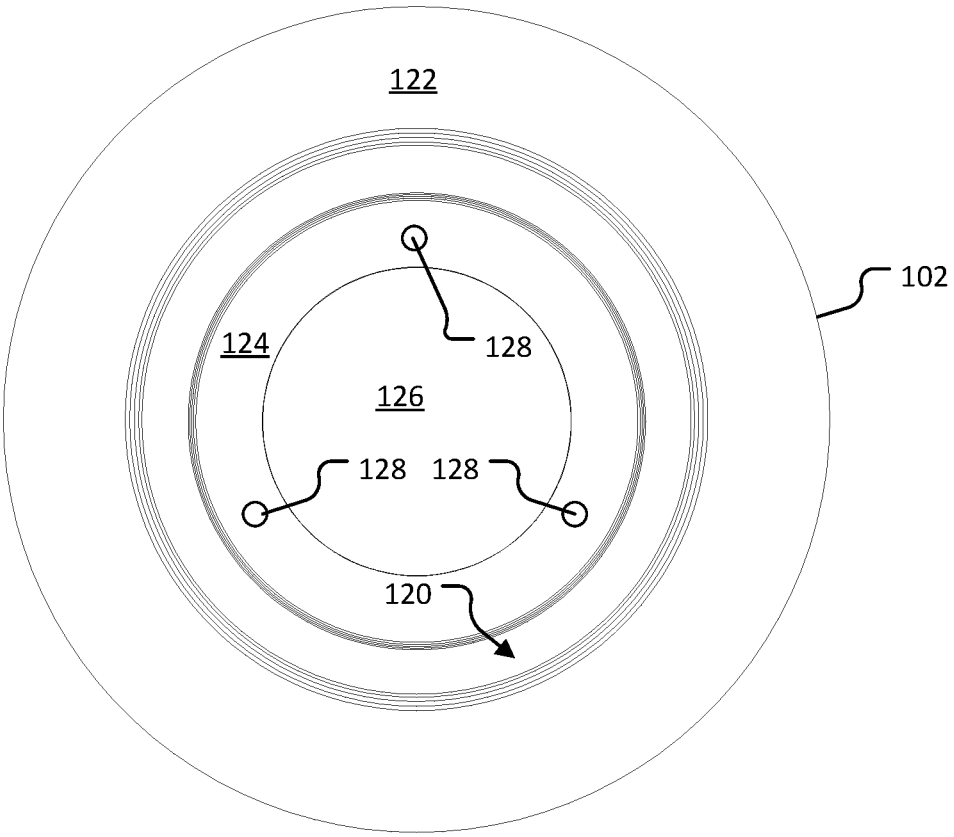
FIG. 2B is a top view of a base plate according to one embodiment of the present invention.

Referring to FIGS. 2A-2B, detailed diagrams of one embodiment of the base plate 102 are illustrated. FIG. 2A is an isometric view of the base plate 102 and FIG. 2B is a top view of the base plate 102.

In one embodiment, the base plate 102 can be manufactured from a relatively thin stainless steel plate. As can be appreciated, the base plate 102 can be comprised of other suitable materials. As shown, the base plate 102 can be characterized by a cylindrical recess 120 that can be adapted to fit into a hole prepared in a subfloor. The base 102 can be supported in the hole by a substantially horizontal radial flange 122 that extends outwardly from a top of the recess 120. A bottom of the recess 124, which can be located a predetermined distance below the surface of the subfloor, can include a round center opening 126 configured to receive the drain body 104 there through. In another embodiment, the base plate 102 can be defined by a substantially frustoconical shape with a flange extending out radially from a top of the base plate 102 and a hole located approximate a middle of a bottom of the base plate 102.

To attach to the drain body 104, the bottom of the recess 124 can include a plurality of holes 128 adapted to receive a fastener. For illustrative purposes only, three holes are shown in FIGS. 2A-2B. In one example, the three holes 128 can be located outwardly of the center opening 126 and can be spaced apart approximately 120 degrees from each other with each being sized to receive a fastener there through. Typically, each of the holes 128 can be can be positioned at locations a first radial distance from a center axis of the base plate 102. Variations with two fastener holes or four fastener holes are also contemplated. Typically, the base plate 102 can be adhesively secured to a subfloor, mechanically fastened to the subfloor, and/or just set in place.

Figure 3A:
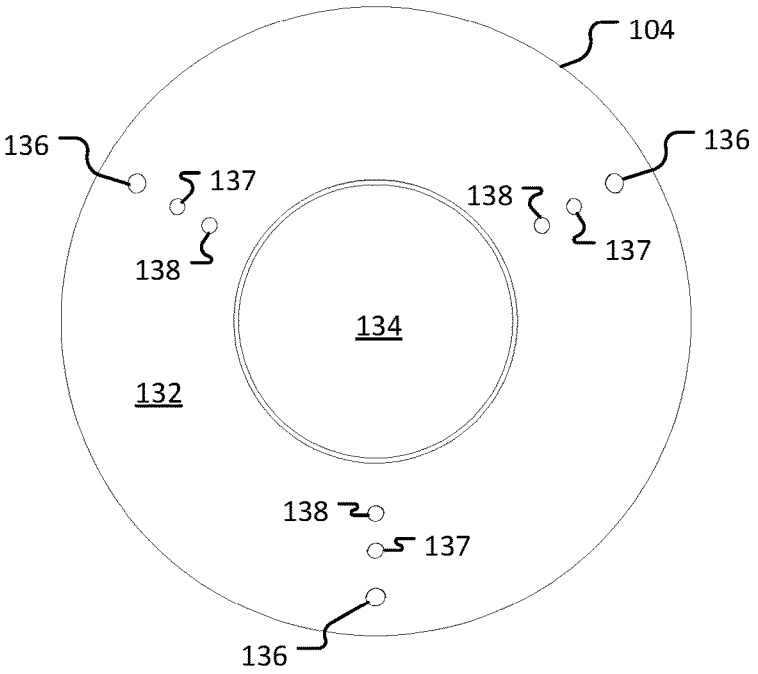
FIG. 3A is a top view of a drain body according to one embodiment of the present invention.
Figure 3B:
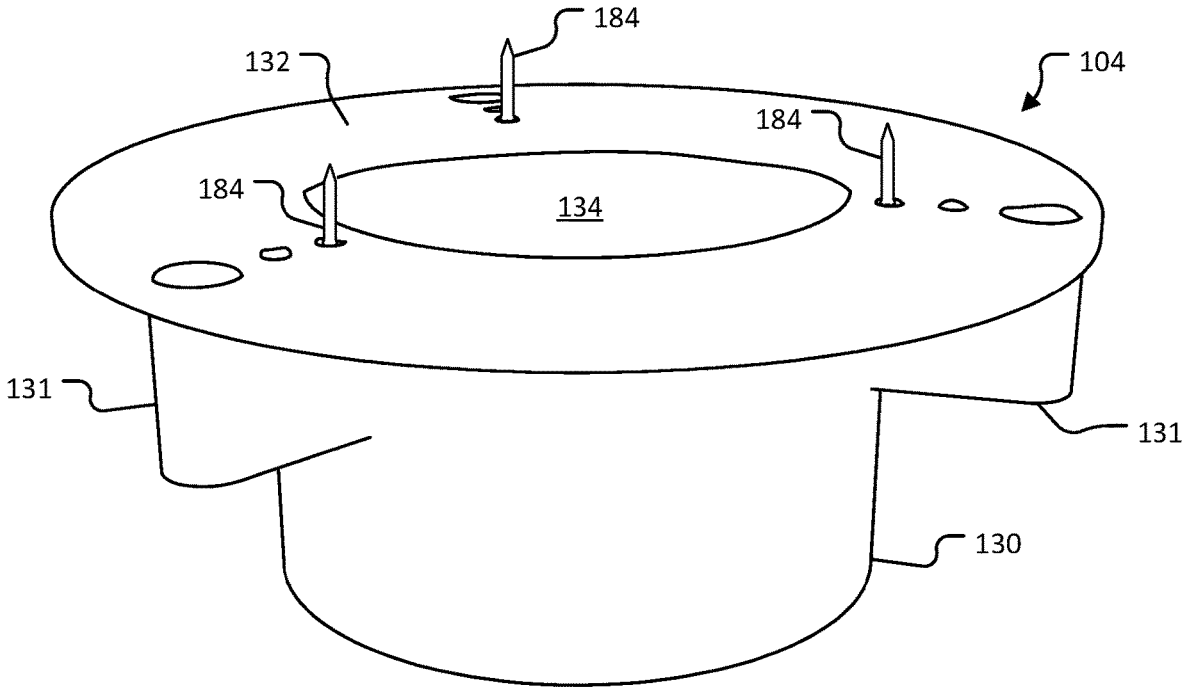
FIG. 3B is an isometric view of a drain body according to one embodiment of the present invention.
Figure 3C:
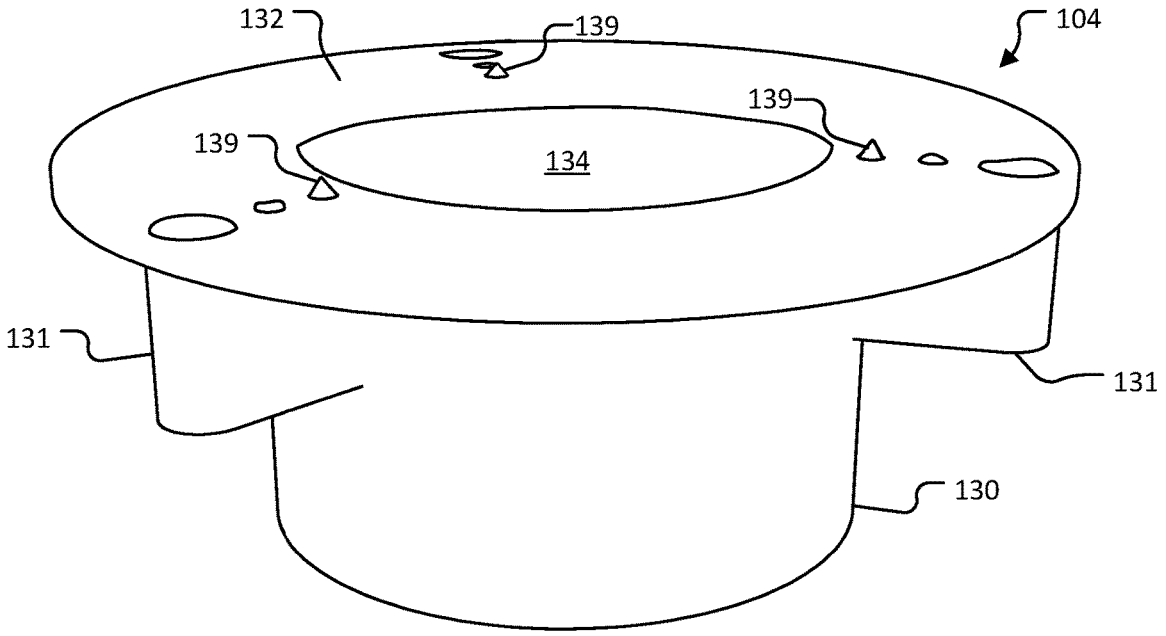
FIG. 3C is an isometric view of a drain body according to an alternative embodiment of the present invention.
Figure 3D:
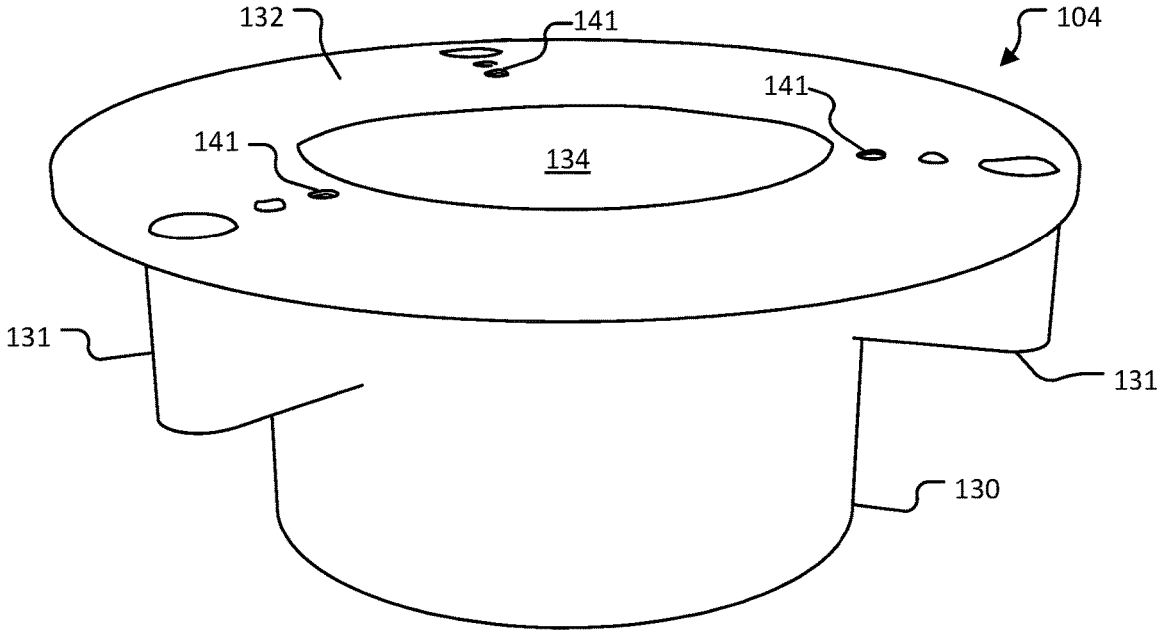
FIG. 3D is an isometric view of a drain body according to another alternative embodiment of the present invention.

Referring to FIGS. 3A-3B, detailed diagrams of one embodiment of the drain body 104 are illustrated. FIG. 3A is a top view of the drain body 104 and FIG. 3B is an isometric view of the drain body 104.

The drain body 104 can typically be fabricated from PVC; although in other variations can be made from other suitable materials. As shown, the drain body 104 can include a first portion 130 being substantially cylindrical and a second portion 132 being a horizontally disposed flange that can extend outwardly from a top of the substantially cylindrical portion 130. The cylindrical portion 130 and the flange portion 132 can include a round center opening 134 with an inside diameter configured to be only slightly greater than an outside diameter of a drain pipe the drain body 104 is designed to receive. Typically, the round center opening 134 can be sized to permit the drain body 104 to be solvent bonded to a drain pipe. Typically, a top surface of the flange portion 132 can be substantially flat. The drain body 104 can further include a plurality of radially extending legs 131 proximate a bottom of the flange portion 132 and extending out from the cylindrical portion 130. Typically, a bottom of the legs 131 can interface with the bottom of the recess 124 of the base plate 102.

As shown in FIGS. 3A-3B, the top of the flange portion 132 can include a first set of holes 136, a second set of holes 137, and a third set of holes 138. The first set of holes 136 can be positioned at locations a first radial distance from a center axis of the drain body 104 (e.g., a substantially similar distance to the first radial distance of the holes 128 of the base plate 102), the second set of holes 137 can be located a second radial distance from the center axis of the drain body 104, and the third set of holes 138 can be located a third radial distance from the center axis of the drain body 104. Typically, each of the holes in one of the set of holes 136-137 can be spaced apart approximately 120 degrees from each other.

The first set of holes 136 can be beveled on top of the flange 132 to flushly receive a head of a first fastener 180 (shown in FIG. 1A) there against. Although only one fastener 180 is shown, it is to be appreciated that a plurality of fasteners 180 can be implemented. Each of the first set of holes 136 can extend down through the legs 131. Ends of the associated fasteners 180 can be received in corresponding threaded holes 128 in the base plate 102.

The second set of holes 137 can be configured to receive one of a plurality of second fasteners 182 to secure the drain body 104 to the clamping collar 106, discussed in more detail further on. For instance, the second set of holes 137 can be threaded to receive a threaded fastener.

In one embodiment, the third set of holes 138 can each be configured to receive a rod 184. The rod 184 can be implemented to pierce through the gasket 114 to help align holes of the clamping collar 106 with the second set of holes 137 of the drain body 102. In another embodiment, the third set of holes 138 can each be replaced with a protrusion 139 that extends up from the flange 132. In one example, the protrusions 139 can have a pointed end to pierce through a gasket to help align the drain body 104 with the clamping collar 106. In another embodiment, the third set of holes 138 can each be replaced with a depression 141 that extends into the flange 132. The bottom of the clamping collar 106 can include a plurality of protrusions 143 extending from a bottom of the clamping collar 106 adapted to interface with the depressions 141 of the drain body 102.

Figure 4A:
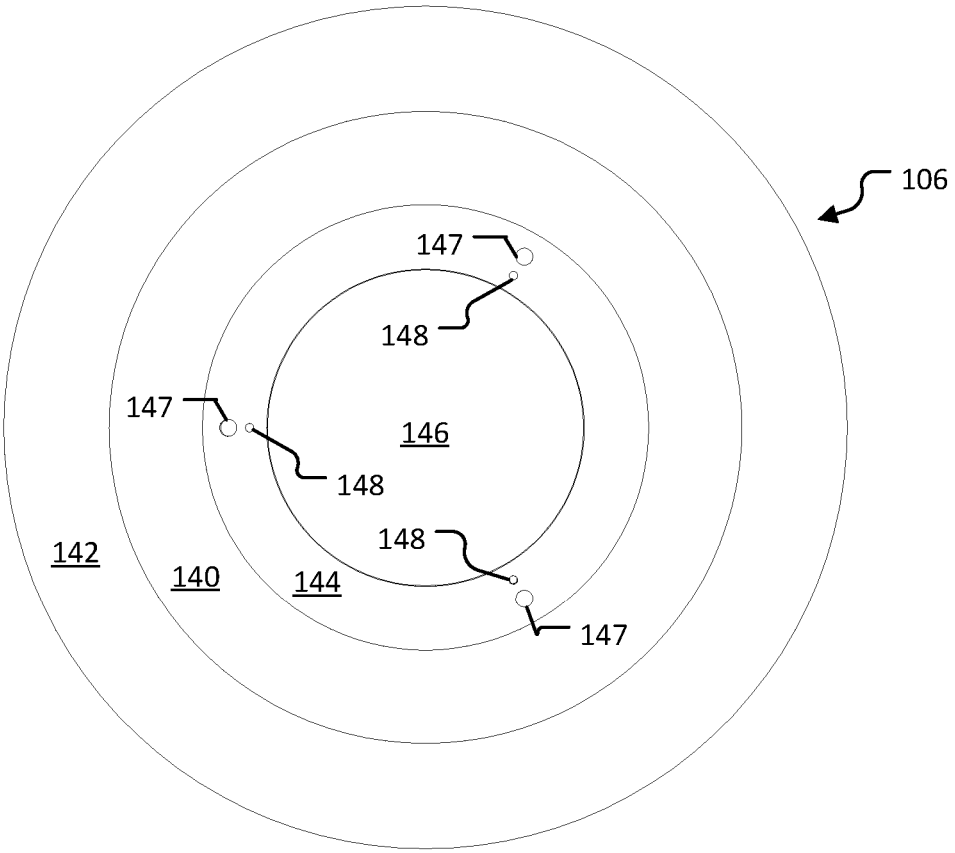
FIG. 4A is a top view of a clamping collar according to one embodiment of the present invention.
Figure 4B:
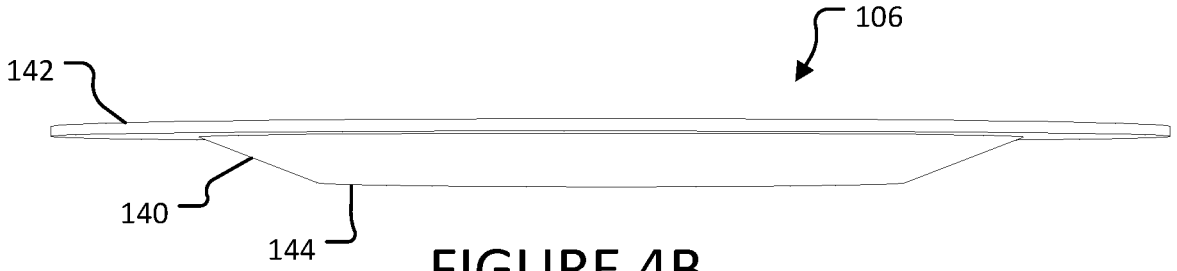
FIG. 4B is a side view of a clamping collar according to one embodiment of the present invention.
Figure 4C:
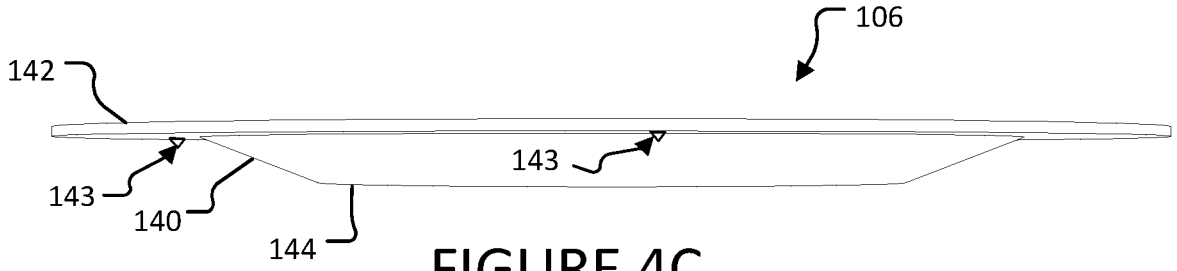
FIG. 4C is a side view of a clamping collar according to an alternative embodiment of the present invention.

Referring to FIGS. 4A-4B, detailed diagrams of one embodiment of the clamping collar 106 are illustrated. FIG. 4A is a top view of the clamping collar 106 and FIG. 4B is a side view of the clamping collar 106.

The clamping collar 106 can typically be fabricated from PVC; although in other variations can be made from other suitable materials. As shown, the clamping collar 106 can be characterized by a cylindrical recess 140 that can be adapted to interface with the gasket 114. The clamping collar 106 can include a substantially horizontal radial flange 142 that extends outwardly from a top of the recess 140. A bottom of the recess 144, which can have a predetermined height, can include a round center opening 146. In one embodiment, a bottom surface of the flange 142 can be substantially flat. In use, the gasket 114 can be sandwiched between the drain body 104 and the clamping collar 106 in a water-tight arrangement.

As shown in FIG. 4A, the bottom of the recess 144 can include a first set of holes 147 and a second set of holes 148. The first set of holes 147 can be positioned at locations approximately equal to the second radial distance from a center axis of the clamping collar 106 and the second set of holes 148 can be located approximately equal to the third radial distance from the center axis of the clamping collar 106. For example, when the drain body 104 can the clamping collar 106 are concentric, the second set of holes 137 of the drain body 104 can align with the first set of holes 147 of the clamping collar and the third set of holes 138 of the drain body 104 can align with the second set of holes 148 of the clamping collar 106. Similar to the base plate 102 and the drain body 104, each of the holes in each set of holes 147-148 can be spaced apart approximately 120 degrees from each other.

In one embodiment, the first set of holes 147 can be beveled on top of the bottom of the recess 144 to flushly receive a head of a fastener 182 there against. The threaded ends of the associated threaded fasteners 182 can be received in corresponding threaded holes 137 in the drain body 104. Operationally, by tightening the fasteners 182, the gasket 114 can be firmly clenched between the clamping collar 106 and the drain body 104.

The second set of holes 148 can be configured to receive the rods 184 placed in the third set of holes 138 of the drain body 104. As can be appreciated, the second set of holes 148 can help align the first set of holes 147 of the clamping collar 106 with the second set of holes 137 of the drain body 104. A fastener can then be passed through the first set of holes 147 of the clamping collar 106 to interface with the second set of holes 137 of the drain body 104. As can be appreciated, with the gasket 114 covering the holes of the drain body 104, the rods 184 can be implemented to line the holes of the drain body 104 with the clamping collar 106.

In one example, the second set of holes 137 can be threaded and adapted to receive threaded ends of associated fasteners 182 passing through the corresponding first set of holes 147 in the clamping collar 106. Typically, a flat membrane gasket can be sandwiched between a bottom surface of the clamping collar 106 and a top surface of the drain body 104 to create a watertight seal when the fasteners 182 are tightened.

In one embodiment, the base plate 102 can include a set of holes that are provided to permit ends of the clamping collar fasteners to pass there through if need be. As can be appreciated, these holes can be larger than a diameter of the fasteners and do not interact therewith.

Of note, the clamping collar 106 can be substantially flat or have a slight recess (as shown). In one embodiment, the recess can be up to about 0.25" deep to accommodate a flat membrane gasket that does not need to be preformed to include a frustoconical portion. In some embodiments, elastic membranes may be utilized that can stretch and deform without forming creases as necessary. Where the clamping collar 106 can be substantially flat, less compliant membranes can be employed.

Figure 5A:
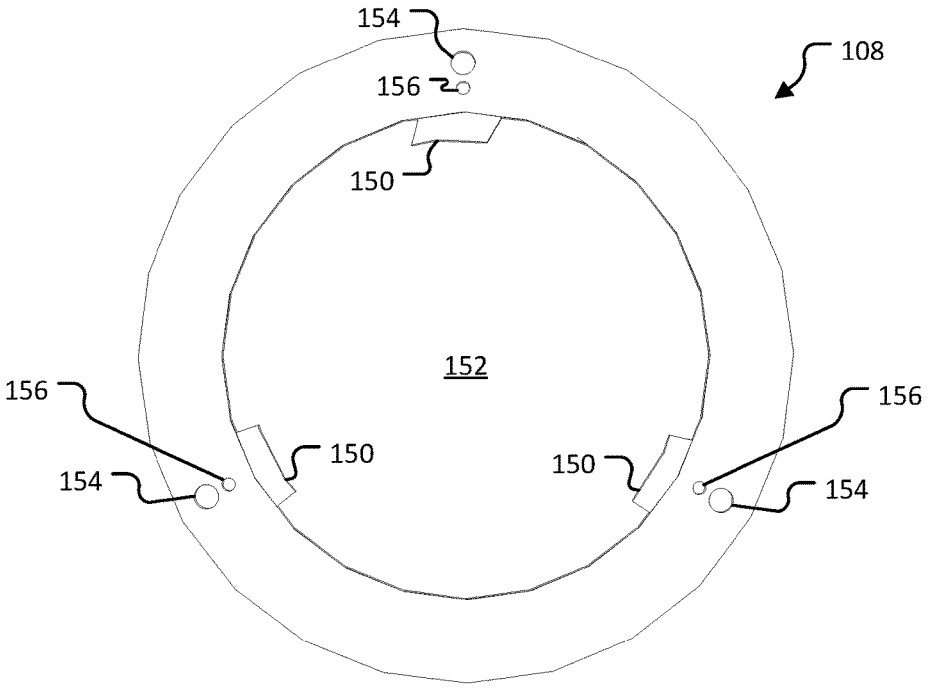
FIG. 5A is a top view of a ring member according to one embodiment of the present invention.
Figure 5B:
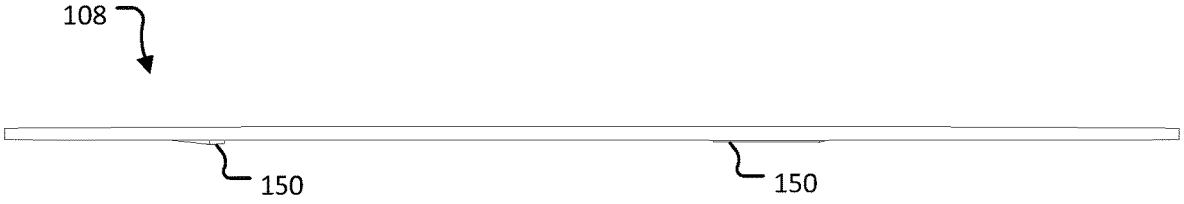
FIG. 5B is a side view of a ring member according to one embodiment of the present invention.

Referring to FIGS. 5A-5B, detailed diagrams of the ring member 108 are illustrated. FIG. 5A shows a top view of the ring member 108 and FIG. 5B shows a side view of the ring member 108. In some embodiments, the recessed point drain 100 can include the ring member 108 to threadably couple to a drain cover assembly.

As shown in FIG. 5A, the ring member 108 can be a ring including two or more protrusions 150 that extend inwardly from a circumferential edge of a center hole 152 of the ring member 108. As shown in FIG. 5B, the ring member 108 can be substantially flat. In some embodiments, the protrusions 150 can be canted down or up to better mate with a threaded surface.

The ring member 108 can include a first set of holes 154 and a second set of holes 156. The first set of holes 154 can be positioned at locations a first radial distance from a center axis of the ring member 108 and the second set of holes 156 can be located a second radial distance from the center axis of the ring member 108. The first set of holes 154 can be implemented to receive the fastener 182 that can be passed through the first set of holes 147 of the clamping collar 106 and then the second set of holes 137 of the drain body 104. As can be appreciated, the ring member 108 can be coupled to the clamping collar 106. The second set of holes 156 can be implemented to receive the rod 184 initially set into the drain body 104 to align the ring member 108 with the clamping collar 106 and the drain body 104.

The protrusions 150 can be implemented to threadably interface with a drain cover assembly including a female threaded surface. As can be appreciated, a drain cover assembly having threads located on an exterior surface of a pipe can be threadably engaged to the protrusions 150.

Figure 6A:
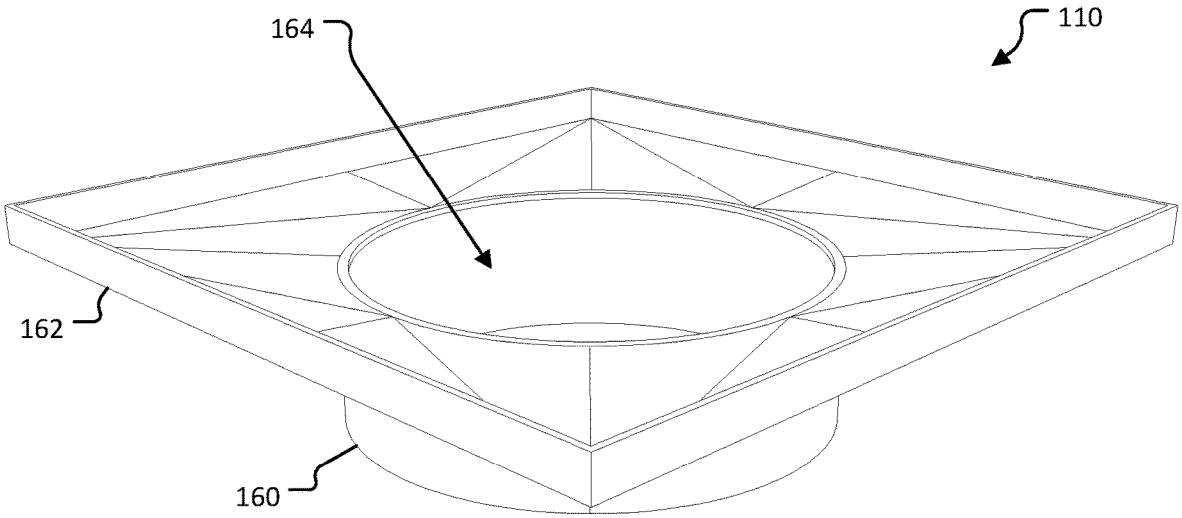
FIG. 6A is an isometric view of a strainer base according to one embodiment of the present invention.
Figure 6B:
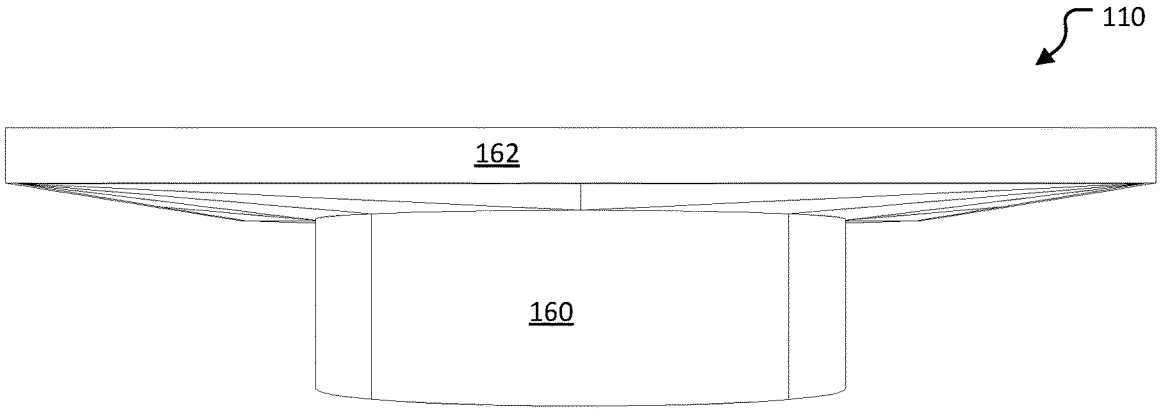
FIG. 6B is a side view of a strainer base according to one embodiment of the present invention.

Referring to FIGS. 6A-6B, detailed diagrams of one embodiment of the strainer base 110 are illustrated. FIG. 6A is an isometric view of the strainer base 110 and FIG. 6B is a side view of the strainer base 110. In one embodiment, the strainer base 110 can be configured to be inserted into center holes of the clamping collar 106 and the drain body 104.

The strainer base 110 can include a substantially cylindrically shaped lower portion 160 and an upper tray portion 162. The lower portion 160 can be sized to fit within the center holes of the drain body 104 and the clamping collar 106. In one instance, the tray portion 162 can have a substantially square shape. As shown in FIG. 6B, a bottom of the tray portion 162 can be slanted down from outer edges of the tray towards a center hole 164 of the strainer base 110. As can be appreciated, water that may pass through the strainer 112 can flow down towards the center hole 164. The tray portion 162 can be sized to receive the strainer 112. Of note, dimensions of the tray portion 162 and the strainer 112 can be altered to fit with various sized tile dimensions. For instance, the tray portion 162 and the strainer 112 may have substantially rectangular shapes. In another instance, the tray portion 162 and the strainer 112 may have substantially hexagonal shapes.

Figure 7:
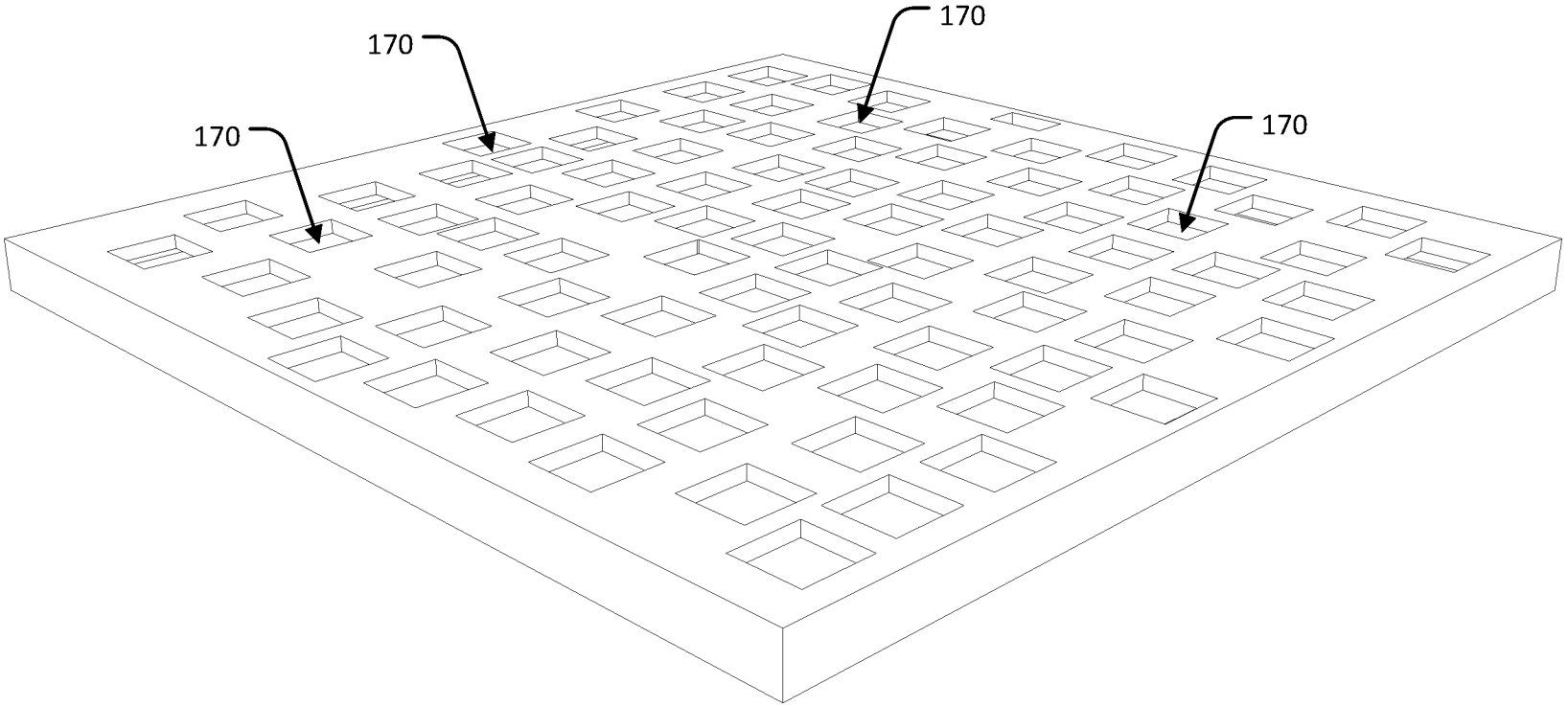
FIG. 7 is an isometric view of a strainer according to one embodiment of the present invention.

Referring to FIG. 7, a detailed diagram of one embodiment of the strainer 112 is illustrated. Typically, the strainer 112 can be sized to fit within the tray 162 of the strainer base 110. As shown, the strainer 112 can have a substantially square shape similar to the tray portion 162 of the strainer base 110. As can be appreciated, the strainer 112 can sit substantially flush with a floor covering surrounding the recessed drain assembly 100. As shown, the strainer 112 can include a plurality of holes 170 to allow water to pass through the strainer 112 down towards a drain pipe.

Referring back to FIG. 1B, a partial cross-sectional view of the recessed point drain assembly 100 resting on a surface of a subfloor 190 is illustrated. As shown, a cross-sectional view of the base plate 102 and subfloor 190 are illustrated with side bottom views of the drain body 104, the clamping collar 106, and the strainer base 110. Of note, the drain body 104 can be sized to fit within the recess 120 of the base plate 102. Typically, a top of the drain body 104 can be below a top of the base plate 102.

The flange 122 of the base plate 102 can interface with a top surface of the subfloor 190 when inserted into the hole in the subfloor. Of note, the radial legs 131 of the drain body 104 can interface with the bottom 124 of the base plate 102. As can be appreciated, a height of the radial legs 131 can dictate a height of the drain 104 relative to the base plate 102.

A typical process for installing the recessed point drain assembly 110 is described herein below. However, it is to be understood that deviations from the described process where additional steps or operations are included or one or more described steps or operations are omitted are contemplated. It is to be further understood that the order of the various steps and operations can be different as described herein.

First, a location where the drain 100 is to be located can be determined and a hole can be cut in the subfloor.

Next, the base plate 102 can be placed in the subfloor hole. In some variations, the base plate 102 can be adhesively or mechanically secured to the subfloor.

After the base plate 102 is placed in the subfloor, the drain body 104 can be placed in the base plate 102 and coupled thereto. To couple the drain body 104 to the base plate 102, the first plurality of holes 136 of the drain body 104 can be lined up with the plurality of holes 128 of the base plate 102. The fasteners 180 can be passed through the first set of holes 136 in the drain body 104 and can threadably engage the plurality of holes 128 of the base plate 102. At this juncture, the drain body 104 can be coupled to a drain pipe.

Next, the plurality of rods 184 can be placed in the third set of holes 138 of the drain body 104. The gasket 114 can then be fitted on top of the drain body 104 with the rods 184 piercing through the gasket 114 to help align the clamping collar 106 to the drain body 104. In an alternative embodiment, the drain body 104 can include a plurality of protrusions instead of the third plurality of holes 138 that can be implemented to help align the clamping collar 106 to the drain body 104.

With the gasket 114 in place and the clamping collar 106 aligned with the drain body 104, the plurality of fasteners 182 can be passed through the first set of holes 147 of the clamping collar 106 to threadably engage the second set of holes 137 of the drain body 104. The fasteners 182 can be tightened with the gasket 114 between the drain body 104 and the clamping collar 106, thus forming a waterproof seal.

As desired or necessary, the gasket 114 can be adhesively secured to the shower subfloor.

Once the recessed point drain assembly 100 is installed, a waterproof membrane can be installed over the floor and overlapping the exterior perimeter of the gasket 114. Tile or another floor covering can be installed over the floor as desired and as appropriate over the recessed point drain assembly 100 with an understanding the any tile or covering extending over the drain will need to allow for the ingress of water there through.

Where the recessed drain point assembly 100 will include the strainer base 110 and the strainer 112, the strainer base 110 will need to be coupled to the drain body 104. In one instance, the lower portion 160 of the strainer base 110 can fit into the cylindrical portion 130 of the drain body 104. In one example, the strainer base 110 can be solvent welded to the drain body 104. In another embodiment, the ring member 108 can be implemented to threadably couple the strainer base 110 in place. In such an instance, an exterior of the lower portion 160 of the strainer base 110 can be threaded.

After the strainer base 110 is coupled to the drain body 104, the strainer 112 can be placed into the tray portion 162 of the strainer base 110. As can be appreciated, water can pass through the strainer 112 into the strainer base 110 and on to a drain pipe.

In instances where the recessed drain point assembly 100 does not include the strainer base 110 and the strainer 112, the ring member 108 can be implemented to couple to a drain cover assembly having threads.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A point drain assembly comprising:
- a rigid plate being defined by:
  - a recess;
  - a flange extending outwardly from a top of the recess; and
  - a bottom of the recess including a circular hole;
  - wherein the bottom of the recess is adapted to be located below a subfloor;
- a drain body having a tubular structure with a flange located proximate a top of the tubular structure, the drain body adapted to be coupled to the rigid plate by a first plurality of fasteners; and
- a clamping collar configured to mate with an upper surface of the drain body, the clamping collar adapted to be coupled to the drain body by a second plurality of fasteners.

2. The point drain assembly of claim 1, wherein (i) the flange of the drain body includes a plurality of counterbores for receiving the first plurality of fasteners; and (ii) a top of each of the first plurality of fasteners sit flush with a top of the flange of the drain body.

3. The point drain assembly of claim 1, wherein (i) the flange of the drain body includes a plurality of holes adapted to mate with the second plurality of fasteners; and (ii) the clamping collar includes a plurality of holes to interface with the second plurality of fasteners.

4. The point drain assembly of claim 1, wherein a top of the flange of the drain body includes a plurality of protrusions extending away from the top of the flange.

5. The point drain assembly of claim 4, wherein a bottom of the clamping collar includes a plurality of holes adapted to interface with the plurality of protrusions.

6. The point drain assembly of claim 5, wherein when the plurality of protrusions are interfacing with the plurality of holes, a plurality of fastener holes of the clamping collar are aligned with a plurality of fastener holes of the drain body.

7. The point drain assembly of claim 1, wherein a top of the flange of the drain body includes a plurality of depressions.

8. The point drain of claim 7, wherein a bottom of the clamping collar includes a plurality of protrusions extending from the bottom of the clamping collar, the plurality of protrusions adapted to interface with the plurality of depressions of the drain body.

9. The point drain assembly of claim 1, wherein the point drain assembly further includes:
- a ring shaped plate having at least two interior protrusions extending towards a center of the ring.

10. The point drain assembly of claim 9, wherein the ring shaped plate is adapted to be threadably engaged to a pipe.

11. A recessed point drain assembly comprising:
- a plate having a frustoconical shape with a flange extending out radially from a top of the plate and a hole located approximate a middle of a bottom of the plate;
- a drain body having a cylindrical tube shape with a flange extending out radially from a top of the tube, the drain body including:
  - a first set of holes located a first radial distance from a center axis of the drain body;
  - a second set of holes located a second radial distance from a center axis of the drain body; and
  - a third set of holes located a third radial distance from a center axis of the drain body;
- a clamping collar including:
  - a first set of holes located at approximately the second radial distance from a center axis of the clamping collar; and
  - a second set of holes located at approximately the third radial distance from a center axis of the clamping collar.

12. The recessed point drain assembly of claim 11, wherein the drain body is configured to partially insert into the hole of the plate.

13. The recessed point drain assembly of claim 11, wherein the plate includes a set of holes located at approximately the first radial distance from a center axis of the plate.

14. The recessed point drain assembly of claim 13, wherein the first set of holes of the drain body are each adapted to receive a first fastener.

15. The recessed point drain assembly of claim 14, wherein each of the first fasteners are adapted to mate with one of holes of the plate.

16. The recessed point drain assembly of claim 11, wherein the clamping collar is coupled to the drain body by second fasteners configured to pass through the first set of holes of the clamping collar and mate with the second set of holes of the drain body.

17. The recessed point drain assembly of claim 11, wherein the bottom of the plate is adapted to be located below a subfloor.

18. The recessed point drain assembly of claim 11, wherein each of the holes of the third set of holes of the drain body is adapted to receive a rod.

19. The recessed point drain assembly of claim 18, wherein the second set of holes of the clamping collar are adapted to receive the rods.

20. A recessed drain point assembly comprising:

a rigid plate being defined by:

a recess;

a flange extending outwardly from a top of the recess; and a bottom of the recess including a circular hole;

wherein the bottom of the recess is adapted to be located below a subfloor;

a drain body having a cylindrical tube shape with a flange extending out radially from a top of the tube, the flange of the drain body including:

a first set of holes located a first radial distance from a center axis of the drain body;

a second set of holes located a second radial distance from a center axis of the drain body; and a plurality of protrusions extending up from a top of the flange located a third radial distance from a center axis of the drain body;

a clamping collar including:

a first set of holes located at approximately the second radial distance from a center axis of the clamping collar; and a second set of holes located at approximately the third radial distance from a center axis of the clamping collar, each one of the second set of holes adapted to receive one of the plurality of protrusions;

a plurality of fasteners adapted to couple the drain body to the rigid plate and the clamping collar to the drain body.

* * * * *